US005783783A

United States Patent [19]

Toutaoui et al.

[11] Patent Number: 5,783,783

[45] Date of Patent: Jul. 21, 1998

[54] CORRECTION RUN FOR AN ELEVATOR SYSTEM

[75] Inventors: Mustapha Toutaoui; Jan Kradin, both of Berlin, Germany

[73] Assignee: Otis Elevator Company, Farmington, Conn.

[21] Appl. No.: 538,996

[22] Filed: Oct. 5, 1995

[51] Int. Cl.[6] ..... B66B 1/34

[52] U.S. Cl. ..... 187/394; 187/391; 187/294

[58] Field of Search ..... 187/394, 393, 187/391, 294

[56] References Cited

U.S. PATENT DOCUMENTS

| | | | |
|---|---|---|---|
| 3,773,146 | 11/1973 | Dixon, Jr. et al. | 187/394 |
| 3,889,231 | 6/1975 | Tosato et al. | 187/394 |
| 4,436,185 | 3/1984 | Ludwig et al. | 187/394 |
| 4,750,592 | 6/1988 | Watt | 187/394 |
| 4,756,389 | 7/1988 | Sakata et al. | 187/394 |
| 4,798,267 | 1/1989 | Foster et al. | 187/394 |
| 5,631,452 | 5/1997 | Jamieson et al. | 187/394 |

*Primary Examiner*—Robert Nappi

[57] ABSTRACT

A method for performing a correction run by an elevator system having an elevator car following a loss of an elevator car position information includes: detecting a terminal landing magnet in response to the loss of the elevator position information; moving the elevator car away from a predetermined terminal landing until the terminal landing magnet is not detected; running the elevator car toward the predetermined terminal landing in response to not detecting the terminal landing magnet in said moving step; detecting two magnets simultaneously in response to running the elevator car toward the predetermined landing terminal; stopping the elevator car in response to simultaneously detecting the two magnets; and resetting the elevator position information in response to said stopping step.

5 Claims, 4 Drawing Sheets

CORRECTION RUN FOR AN ELEVATOR SYSTEM

TECHNICAL FIELD

The present invention relates generally to elevators and, in particular, relates to a correction run for an elevator system.

BACKGROUND OF THE INVENTION

An elevator system, to operate properly, must know the current elevator car position at all times. Accordingly, elevator position devices are commonly used to monitor car position. However, after a power loss or hard system reset, an elevator control system may not retain the current car position. For example, if a shaft encoder is used for position information, the shaft encoder may only provide relative position movement after a power loss; absolute position information is not provided if the running total of shaft revolutions has been lost.

One method of determining car position after a power loss is known as a terminal position recovery run. In the terminal position recovery run, the elevator is moved to one landing at the end of the hoistway where an initialization switch is actuated and the position of the elevator car is thereafter known. This method, however, requires that one long initialization magnet and one door zone magnet be placed at both a top and a bottom landing; this allows the elevator system to determine the location of the elevator car as the elevator car is moved to either the top or bottom landing. The length of both initialization magnets is dependent on an elevator car maximum velocity and an elevator car deceleration.

If elevator car position information is lost as the elevator car is between the terminal landings then the elevator system will always cause the elevator car to run to the same terminal to reset the elevator position device. If, however, the elevator car position information is lost near one of the terminal landings, such that the elevator position device detects one of the long initialization magnets, then the elevator controller cannot use that landing to reset the elevator position device because high performance leveling with that landing cannot be guaranteed. Accordingly, if the elevator car position information is lost as the elevator car is located near one of the terminal landings, the elevator controller causes the elevator car to perform a long correction run to the other end of the hoistway to reset the elevator position device. The long correction run ensures high performance leveling of the elevator car but it also requires a large amount of time to complete and is detrimental to elevator service performance.

Additionally, the initialization magnets have opposite polarities so that the elevator system can distinguish between the top and bottom terminal landings. Accordingly, three sensors are required for the correction run; one sensor for the door zone and one initialization sensor for each polarity of the initialization magnets. The sensors and the long magnets add significant costs to the elevator position device.

DISCLOSURE OF THE INVENTION

It is therefore an object of the present invention to provide a cost effective correction run method.

According to the present invention, a method for performing a correction run by an elevator system having an elevator car following a loss of an elevator car position information includes: detecting a terminal landing magnet in response to the loss of the elevator position information; moving the elevator car away from a predetermined terminal landing until the terminal landing magnet is not detected; running the elevator car toward the predetermined terminal landing in response to not detecting the terminal landing magnet in said moving step; detecting two magnets simultaneously in response to running the elevator car toward the predetermined landing terminal; stopping the elevator car in response to simultaneously detecting the two magnets; and resetting the elevator position information in response to said stopping step.

Accordingly, the present invention provides a short run if the elevator position information is lost as the elevator car is near the predetermined terminal landing; whereas, a long run was required in the past if the elevator position information is lost as the elevator car is near any terminal landing. The present invention, therefore, reduces service time if a power loss occurs as the elevator car is located near the predetermined terminal landing.

Additionally, the present invention eliminates one sensor and one long magnet while simultaneously providing improved service because only one sensor is required by the present invention to detect first and second terminal landing magnets; whereas, in the past at least two sensors and two long magnets were required.

BEST MODE FOR CARRYING OUT THE INVENTION

Figure 1:
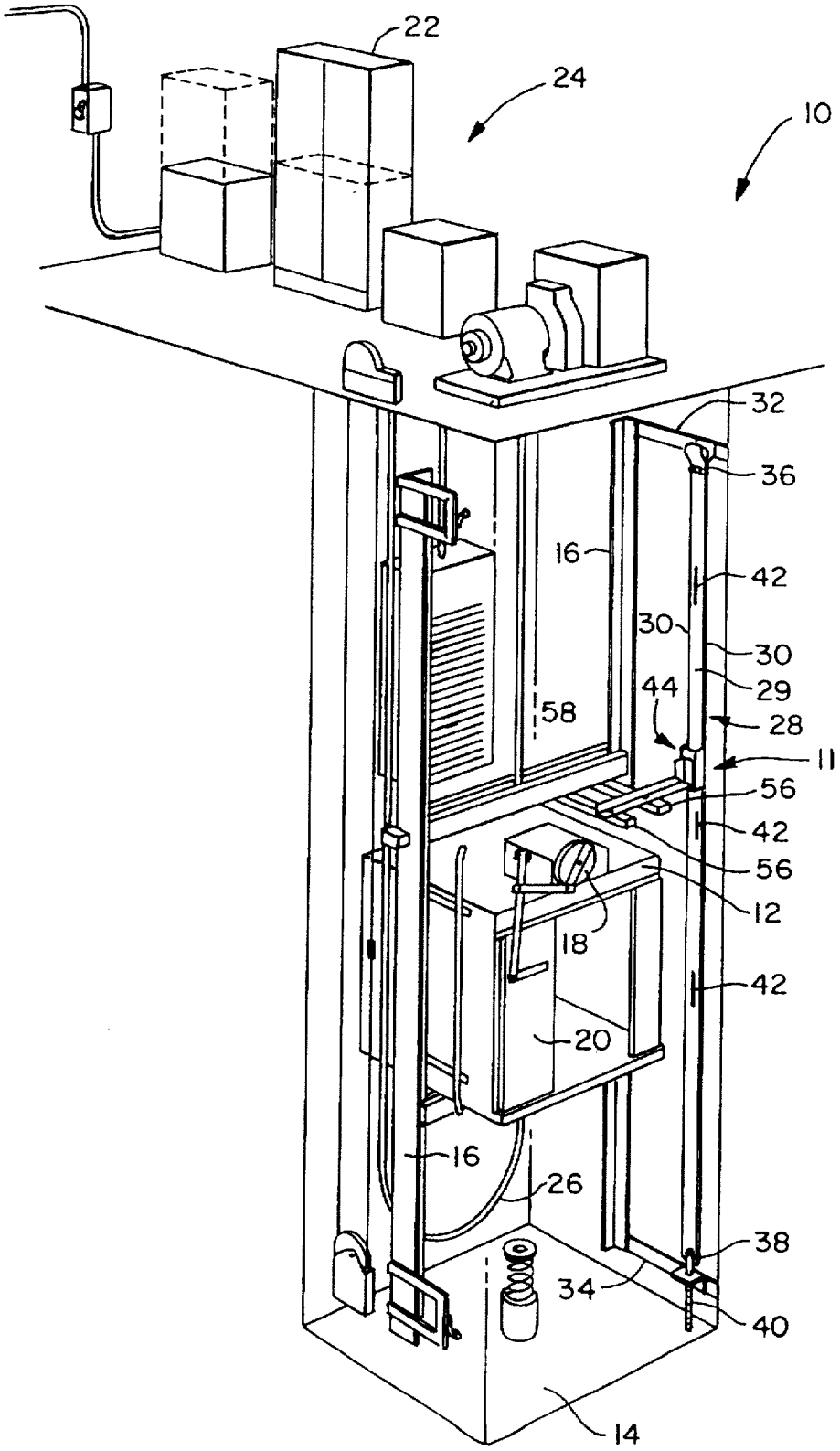
FIG. 1 is a perspective view of an elevator system incorporating an embodiment of the present invention.

Referring to FIG. 1, an elevator system 10 employing an embodiment of an elevator position system 11 is shown. An elevator car 12 is disposed in a hoistway 14 such that the elevator car 12 may travel along elevator guide rails 16 disposed vertically in the hoistway 14. A door operator 18 is disposed on the elevator car 12 so that the door operator 18 may open and close the elevator door(s) 20 as needed. An elevator controller 22 is disposed in a machine room 24 which monitors and provides system control of the elevator system 10. The elevator controller 10 includes a memory (not shown) in which programming that embodies the present invention is embedded. A traveling cable 26 is used to provide an electrical connection between the elevator controller 22 and electrical equipment in the hoistway 14. Of course, it should be realized that the present invention can be used in conjunction with other elevator systems including hydraulic and linear motor systems, among others.

Figure 2:
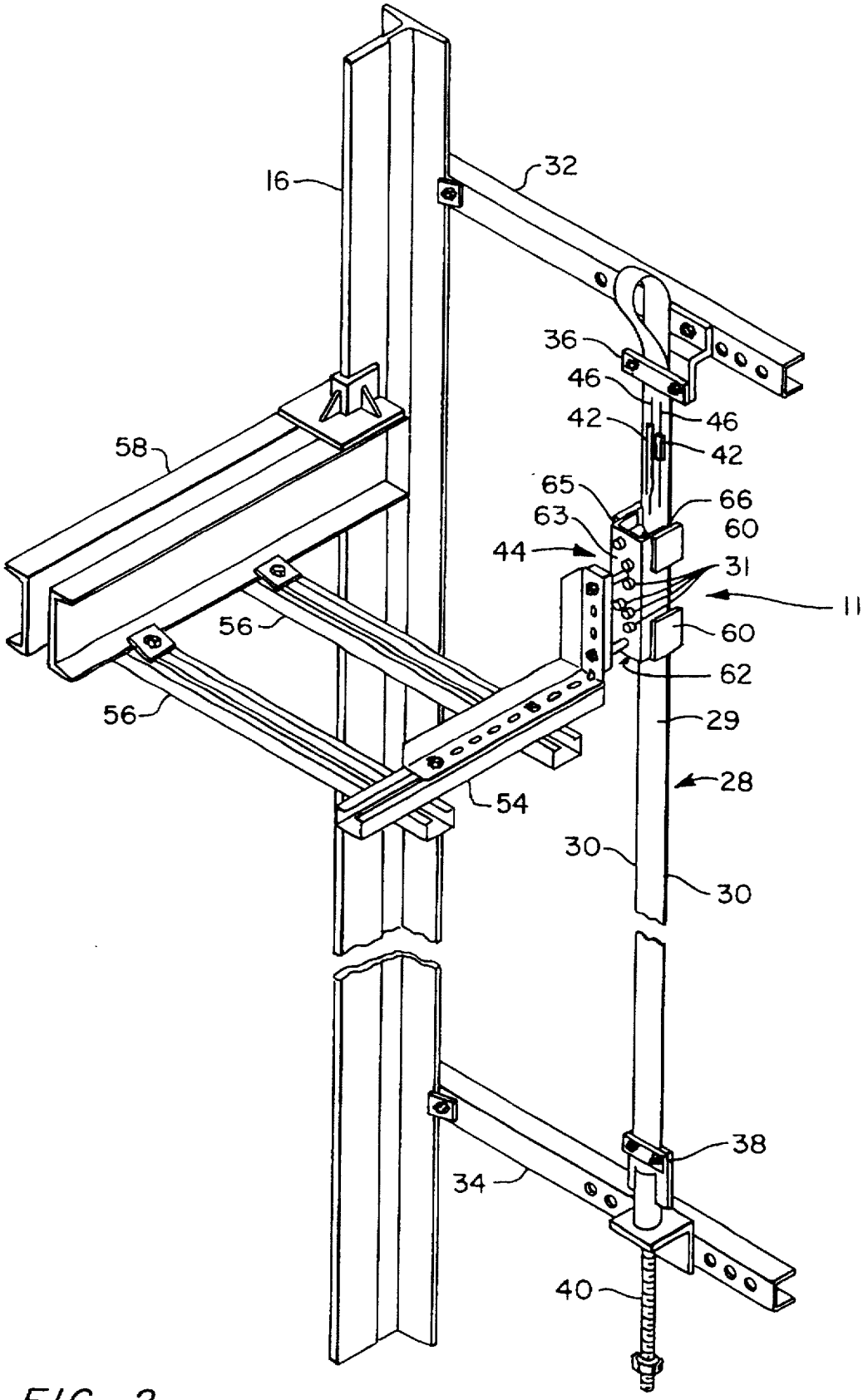
FIG. 2 is a perspective view of an embodiment of an elevator position system.

Referring to FIGS. 1 and 2, the elevator position system 11 is used in conjunction with the elevator system 10 to accurately determine the position of the elevator car 12 within the hoistway 14. In one embodiment, the elevator position system 11 includes an encoded medium 28, a plurality of sensor modules 31, and a reader 44.

One embodiment of the encoded medium 28 includes a steel tape 29, having outer edges 30, disposed vertically in the hoistway 14. The steel tape 29 is attached to upper and lower horizontal supports 32, 34 by upper and lower tape hitches 36, 38 respectively. The upper and lower supports 32, 34 provide vertical support to the steel tape 29 and are attached to the guide rails 16. Additionally, a spring 40 is used in conjunction with the lower hitch 38 for providing tension in the steel tape 29. It should be understood by one skilled in the art that other suitable encoded mediums can be used without departing from the spirit and scope of the present invention.

The encoded medium 28 may be encoded using various methods. For example, optical or mechanical encoding methods can be used. In a preferred embodiment, the encoded medium 28 is encoded by disposing magnets 42 on the steel tape 29 in predetermined positions. For example, magnets 42 are located on the steel tape 29 with respect to their corresponding hoistway landings (not shown) to mark the appropriate door zone. In a particular embodiment, the steel tape 29 includes one to three discrete vertical planes ("traces") 46 for placing magnets 42. Each magnet 42 is positioned along one of the traces 46 in the steel tape 29.

Figure 3A:
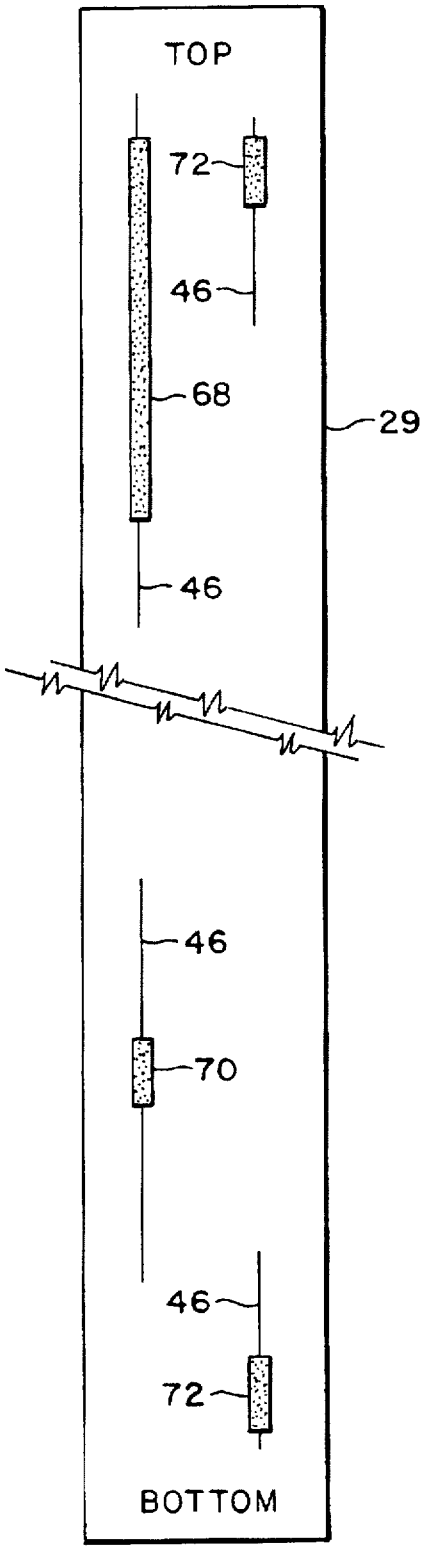
FIGS. 3*a*, 3*b* are front views of an embodiment of an encoded medium.

Referring to FIG. 3*a*, according to the present invention, a first terminal landing magnet 68 is disposed on the steel tape 29 at the top terminal landing and a second terminal landing magnet 70 is disposed on the steel tape 29 at the bottom terminal landing. Both magnets 68, 70 are of the same polarity and are disposed in the same trace 46. Thus, only one sensor module is required to detect the first and second terminal landing magnets 68, 70. Additionally, a door zone magnet 72 is disposed at each terminal landing. The door zone magnet 72 assists the elevator system 10 with leveling the elevator car 12 with the landing where the door zone magnet 72 is located; thus, the door zone magnet is also known as a leveling magnet. In operation, the elevator system 10 begins deceleration as the first terminal landing magnet 68 is detected and stops the elevator car 12 as both the first terminal landing magnet 68 and a door zone magnet 72 is detected as is explained in detail hereinbelow. The second terminal landing magnet 70 allows the elevator car 12 to begin deceleration at its respective terminal only during an inspection run. The second terminal landing magnet 70 may be removed if another technique is used to decelerate the elevator car 12 during the inspection run.

Only the length of the first terminal landing magnet 68 is dependent on an elevator car maximum velocity and an elevator car deceleration. In one particular embodiment, the first terminal landing magnet 68 is approximately 2 meters in length. The length of the second terminal landing magnet 70, however, is small as compared to the first terminal landing magnet 68. For example, the second terminal landing magnet 70 is approximately 250 mm. The length of the door zone magnet 72 is approximately 250 mm.

Figure 3B:
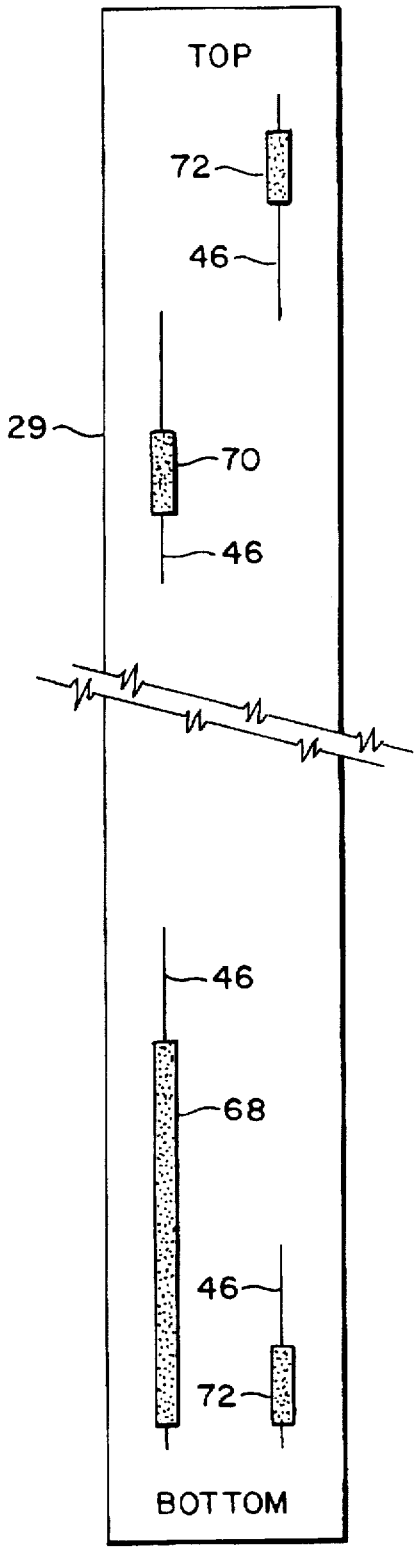

FIG. 3*b* shows an alternate configuration of the terminal landing magnets 68, 70, 72. In this configuration, the second terminal landing magnet 70 is disposed on the steel tape 29 at the top terminal landing and the first terminal landing magnet 68 is disposed on the steel tape 29 at the bottom terminal landing. A correction run according to the present invention is achieved using either the magnet configuration shown in FIG. 3*a* or in FIG. 3*b*. Accordingly, the terminal where the first terminal landing magnet 68 is disposed is defined as the predetermined terminal landing.

Referring again to FIG. 2, the sensors modules 31 are used to detect the encoding embodied in the encoded medium 28. In one embodiment, the sensors modules 31 are hall effect devices which produce electrical sensor signals when placed in close proximity to the magnets 42. Each sensor module 31 includes a hall sensor, voltage stabilization circuitry and power circuitry. The hall sensor provides a sensor signal in response to sensing the magnets 42. The voltage stabilization circuitry stabilizes an unregulated voltage provided by either the controller 22 or a battery (not shown) and provides the stabilized voltage to the hall sensor. The power circuitry provides amplification to the sensor signal. Suitable designs for the voltage stabilization circuitry and the power circuitry are known to those skilled in the art. The sensors modules 31 are disposed in the reader 44 as is described hereinbelow. It should be understood by one skilled in the art that other sensor devices can be used without departing from the spirit and scope of the present invention.

The reader 44 is attached to an angle bracket 54 which is attached to mounting channels 56 which in turn are attached to the crosshead 58 of the elevator car 12. As a result, the reader 44 moves with the elevator car 12 as the elevator car 12 moves up and down the hoistway 14. The reader 44 moves the sensor modules 31 along the encoded medium 28 as the elevator car 12 travels in the hoistway 14.

The reader 44 includes guides 60 and a channel 62 having a mounting plate 63 and two supports 65 extending at ninety degrees from the mounting plate 63. The mounting plate 63 having a group of apertures for receiving the sensor modules 31 as is explained below. In one embodiment, four guides 60 are attached to the channel 62 for facilitating movement of the reader 44 along the encoded medium 28. Each guide 60 has a longitudinal groove 66 defining an area formed therein such that the groove 66 is adapted to receive and retain the outer edges 30 of the steel tape 29. As the elevator car 12 travels in a direction in the hoistway 14, the reader 44 travels in the same direction with the outer edges 30 of the steel tape 29 traversing through the grooves 66 formed in the guides 60. Thus, a constant distance between the sensor modules 31 and the steel tape 29 is maintained as the reader 44 travels in the hoistway 14. It should be understood by one skilled in the art that other suitable readers can be used without departing from the spirit and scope of the present invention.

The sensor modules 31 are disposed in the apertures such that the sensor modules 31 face the steel tape 29 and are affixed to the channel 62 in a conventional manner by use of a known fastening means such as a threaded nut. The sensor modules 31 are disposed in the same trace 46 as their corresponding magnets 42 so that the sensor modules 31 detect the location of their corresponding magnets 42 as the elevator car 12 and the reader 44 travels in the hoistway 14.

Figure 4:
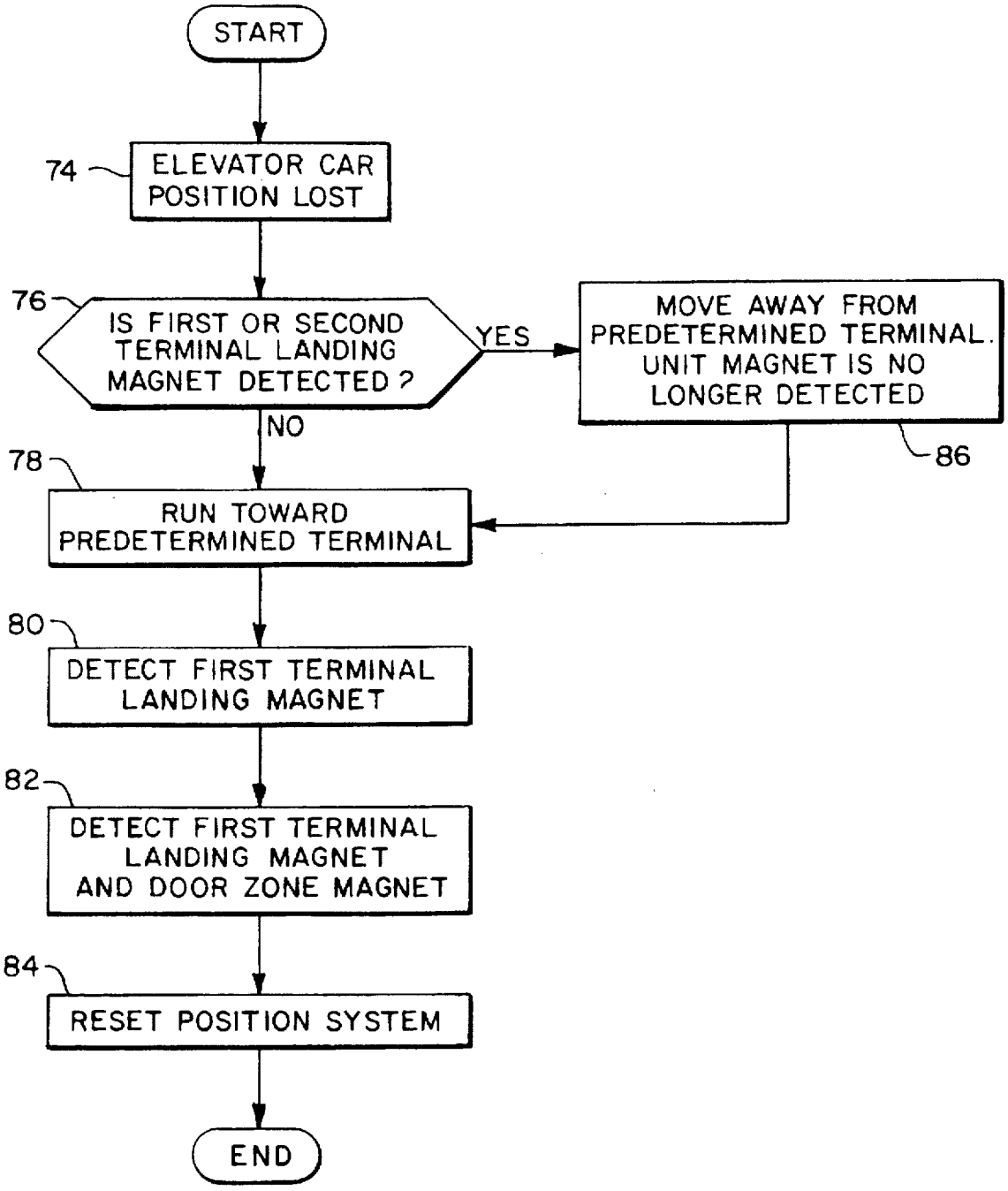
FIG. 4 is a flow diagram of a correction run for an elevator system embodying the principles of the present invention.

Referring to FIGS. 3*a*, 4, the present invention performs a correction run after the elevator system has lost elevator car position information in step 74, such as after a power loss or hard system reset. The correction run method according to a particular embodiment is embedded in the memory of the controller 22 and is implemented as follows.

The elevator position system, in the first step 76 performed, determines if either the first or second terminal landing magnet 68, 70 is detected by one sensor module 31 immediately after power is restored to the elevator position system 11. If the first or second terminal landing magnet 68, 70 is not detected then, in the next step 78, the elevator controller causes the elevator car 12 to run in the direction of the first terminal landing magnet 68; i.e., toward the predetermined terminal landing. This situation represents two possibilities: the first being that power is interrupted as the reader 44 is between the first and second terminal landing; the second being that power is interrupted as the reader 44 is between the second terminal landing magnet 70 and the door zone magnet 72 disposed at the bottom terminal. In either case, the controller 22 causes the elevator car 12 to run in the direction of the first terminal landing magnet 68.

Once the first terminal landing magnet 68 is detected in step 80 by the elevator position system 11, the elevator controller 22 begins deceleration of the elevator car 12. If the second terminal landing magnet 70 is detected before the first terminal landing 68, the elevator controller 22 will not begin declaration of the elevator car 12 until the first terminal landing magnet 68 is detected because the length of the second terminal landing magnet 70 was chosen so that the controller ignores the magnet 70 during the correction run; i.e., the length of the magnet 70 is small as described above. Next, the elevator controller 22 causes the elevator car 12 to stop as the first terminal landing magnet 68 and the door zone magnet 72 are simultaneously detected in step 82. The elevator system 10 can resume normal operation after the elevator position system 11 is reset in step 84.

However, if the first or second terminal landing magnet 68, 70 is detected in step 76 then the elevator controller 22 causes the elevator car 12 to away from the first terminal landing magnet 68 until the magnet 68, 70 is no longer detected in step 86; i.e., the elevator car 12 moves away from the predetermined terminal landing. This situation also represents two possibilities: the first being that the power is interrupted as the reader 44 is aligned with the first terminal landing magnet 68 and the second being that the power is interrupted as the reader 44 is aligned with the second terminal landing magnet 70.

Once the terminal landing magnet 68, 70 is not longer detected, the elevator controller, in step 78, causes the elevator car 12 to run in the direction of the first terminal landing magnet 68. The elevator controller 22 begins deceleration of the elevator car 12 once the first terminal landing magnet 68 is detected by the position reference system 11. As both the first terminal landing magnet 68 and the door zone magnet 72 are simultaneously detected, the elevator controller 22, in step 82, causes the elevator car 12 to stop. The position reference system 11 is reset in step 84 as both the first terminal landing magnet 68 and the door zone magnet 72 are simultaneously detected. The elevator system 10 can resume normal operation after the position reference system 11 is reset in step 84.

The present invention eliminates one sensor and one long magnet while simultaneously providing improved service because only one sensor is required by the present invention to detect the first and second terminal landing magnets; whereas, in the past at least two sensors and two long magnets were required.

Additionally, the present invention provides a short run if the elevator position information is lost as the reader is aligned with the first terminal landing magnet; whereas, a long run was required in the past. The present invention, therefore, reduces service time if a power loss occurs as the elevator car is located near the predetermined terminal landing.

Various changes to the above description may be made without departing from the spirit and scope of the present invention as would be obvious to one of ordinary skill in the art of the present invention.

What is claimed is:

1. A method for performing a correction run by an elevator system having an elevator car following a loss of an elevator car position information, said method comprising the steps of:

(a) detecting a terminal landing magnet in response to the loss of the elevator position information;

(b) moving the elevator car away from a predetermined terminal landing until the terminal landing magnet is not detected;

(c) running the elevator car toward the predetermined terminal landing in response to not detecting the terminal landing magnet in said moving step;

(d) detecting two magnets simultaneously in response to running the elevator car toward the predetermined landing terminal;

(e) stopping the elevator car in response to simultaneously detecting the two magnets; and (f) resetting the elevator position information in response to said stopping step.

2. A method for performing a correction run by an elevator system having an elevator car following a loss of an elevator car position information as recited in claim 1, further comprising:

(g) running the elevator car toward the predetermined terminal landing in response to not detecting the terminal landing magnet in said step (a); and (h) then performing said steps (d)–(f).

3. A method for performing a correction run by an elevator system having an elevator car following a loss of an elevator car position information as recited in claim 1, wherein a length of the terminal landing magnet is dependent on an elevator car maximum velocity and an elevator car deceleration.

4. A method for determining position of an elevator car in a hoistway having a predetermined terminal landing following loss of elevator position information, the predetermined terminal landing having a terminal landing magnet and a leveling magnet located thereon, said method comprising the steps of:

determining if the terminal landing magnet is detected;

moving the elevator car away from the terminal landing magnet if the terminal landing magnet is detected;

determining if said terminal landing magnet is detected;

moving the elevator car toward the predetermined terminal landing if said terminal landing magnet is not detected;

determining if the terminal landing magnet and the leveling magnet are detected simultaneously; and setting the position of the elevator car if the terminal landing magnet and the leveling magnet are detected simultaneously.

5. A method for performing a correction run by an elevator system having an elevator car following a loss of an elevator car position information as recited in claim 4, wherein a length of the terminal landing magnet is dependent on an elevator car maximum velocity and an elevator car deceleration.

* * * * *